US005091254A

United States Patent [19]

Mochizuki et al.

[11] Patent Number: 5,091,254

[45] Date of Patent: Feb. 25, 1992

[54] POLYVINYL ALCOHOL MONOFILAMENT YARNS AND PROCESS FOR PRODUCING THE SAME

[75] Inventors: Masatsugu Mochizuki; Kazutaka Kooda; Siro Murakami; Naohiko Nagata; Mitsuo Kawaguchi, all of Kyoto, Japan

[73] Assignee: Unitika Ltd., Hyogo, Japan

[21] Appl. No.: 527,976

[22] Filed: May 24, 1990

[30] Foreign Application Priority Data

May 24, 1989 [JP] Japan ..... 1-130799

[51] Int. Cl.[5] ..... D02G 3/00

[52] U.S. Cl. ..... 428/364; 57/243; 264/210.8; 428/373

[58] Field of Search ..... 428/364; 57/243; 264/210.8

[56] References Cited

U.S. PATENT DOCUMENTS

| | | | |
|---|---|---|---|
| 4,300,343 | 11/1981 | Nakamura et al. | 428/373 |
| 4,603,083 | 7/1986 | Tanaka et al. | 428/364 |
| 4,612,157 | 9/1986 | Genba et al. | 264/210.8 X |
| 4,713,290 | 12/1987 | Kwon et al. | 428/364 |
| 4,737,401 | 4/1988 | Harpell et al. | 428/252 |
| 4,793,131 | 12/1988 | Mizuno et al. | 57/243 |
| 4,851,168 | 7/1989 | Graiver et al. | 264/210.8 X |
| 4,968,561 | 11/1990 | Mizobe et al. | 428/364 X |
| 4,971,861 | 11/1990 | Watanabe et al. | 264/210.8 X |

FOREIGN PATENT DOCUMENTS

| | | |
|---|---|---|
| 0273755 | 6/1988 | European Pat. Off. . |
| 0286112 | 12/1988 | European Pat. Off. . |

OTHER PUBLICATIONS

Patent Abstracts of Japan, vol. 10, No. 36 (C-328) [2093], 13th Feb. 1986; & JP-A-60 185 812 (Toyo Boseki K.K.) 21-09-1985.

*Primary Examiner*—Lorraine T. Kendell

*Attorney, Agent, or Firm*—Sughrue, Mion, Zinn, Macpeak & Seas

[57] ABSTRACT

A high strength and high initial modulus polyvinyl alcohol monofilament yarn and a process for producing the same with high productivity are disclosed, the monofilament yarn comprising polyvinyl alcohol having a polymerization degree of from 1500 to 7000, having a tensile strength of not less than 10 g/d and an initial modulus of not less than 200 g/d, and having a fineness of 100 denier or more; and the process comprising dry-wet spinning a spinning dope prepared by dissolving polyvinyl alcohol having a polymerization degree of from 1500 to 7000 in a solvent and stretching the resulting unstretched filament, wherein a plurality of filaments immediately after being spun from a spinning nozzle having a plurality of orifices are closely adhered and united into a substantially single strand in an inert atmosphere and then introduced into a coagulating bath or a cooling bath.

13 Claims, 1 Drawing Sheet

POLYVINYL ALCOHOL MONOFILAMENT YARNS AND PROCESS FOR PRODUCING THE SAME

FIELD OF THE INVENTION

This invention relates to a polyvinyl alcohol (hereinafter abbreviated as PVA) monofilament yarn and a process for producing the same. More particularly, it relates to a high strength and high initial modulus PVA monofilament yarn having a fineness of 100 denier or more and a process for producing the same with high productivity.

BACKGROUND OF THE INVENTION

A process for obtaining high strength and high initial modulus fibers which comprises gel spinning an ultra-high-molecular-weight polymer solution and stretching the resulting unstretched fiber at a high stretch ratio has recently been developed and is attracting attention.

Polyethylene fibers obtained by the gel spinning technique have higher strength and higher initial modulus than aramide fibers and are now being brought to the commercial stage. Polyethylene fibers, however, have poor heat resistance due to their low melting point, which has been a bar to broadening of their application as industrial materials.

Of general purpose fibers, PVA fibers are excellent in strength and initial modulus and also have a melting point of from 230 to 240° C or even higher and are thus very useful as industrial materials.

Many proposals have hitherto been made in an attempt to improve the strength and initial modulus of PVA fibers. For example, U.S, Pat. No. 4,440,711 discloses a process comprising gel spinning a glycerin solution of an ultra high polymerization degree PVA having a molecular weight of 500,000 or more and stretching the resulting unstretched fibers at a ratio of about 20. However, not only is such an ultra high polymerization degree PVA difficult to commercially produce, but also the spinning solution thereof has too high a viscosity to be easily spun. Since the polymer concentration of the spinning solution has to be reduced to improve spinnability, productivity of this process is low.

U.S. Pat. Application Ser. Nos. 842,577 and 882,049 (corresponding to JP-A-62-282015 (the term "JP-A" as used herein means an "unexamined published Japanese patent application")) disclose a process comprising gel spinning a solution of PVA having a molecular weight of from 100,000 to 500,000 (corresponding to a polymerization degree of from 1400 to 7000) and stretching the resulting unstretched fibers to obtain filaments of 16 to 50 denier. However, while fiber strength is reduced with an increase of fineness as revealed in Table III therein, there is no disclosure as to how to prevent such a strength reduction when the fineness becomes higher. Moreover, the maximum fineness of the filaments obtained by the disclosed process is about 50 denier, and filaments having such a maximum fineness have a strength of only 9.9 g/d and an initial modulus of only 293 g/d. High strength and high initial modulus PVA monofilament yarns as proposed by the present invention cannot be obtained by this process.

U.S. Pat. No. 4,765,937 discloses a process for producing high strength and high initial modulus fibers by spinning a PVA solution in a mixed solvent of water and an organic solvent and stretching the unstretched fibers, followed by heat setting. This patent is silent as to fineness. It is impossible to estimate the fineness only from the conditions given in the working examples of this patent, and monofilaments having a fineness of 100 denier or more cannot be expected from this process.

U.S. Pat. Application Ser. No. 138,109 (corresponding to JP-A-63-165509) discloses a process for producing high strength and high initial modulus fibers by spinning a solution of PVA in a specific solvent and stretching the resulting fibers in multiple stages so as to provide thereto an overall stretch ratio of at least 15. From the disclosure in the working example thereof that unstretched fibers of 5300 d/100 f were stretched at a ratio of from 14.2 to 26.6, it is clear that a single yarn had a fineness of from 4.0 to 7.5 denier. Therefore, this process provides fibers having a fineness of 10 denier at the highest, and is incapable of producing high strength and high initial modulus monofilament yarns having a fineness of 100 denier or more.

Further, U.S. Pat. Nos. 4,698,194 and 4,603,083, JP-A-61-108711 and JP-A-61-215711 disclose a process in which a spinning dope of PVA having a polymerization degree of 1500 or more in dimethyl sulfoxide (hereinafter abbreviated as DMSO) or glycerin is subjected to dry-wet spinning or gel spinning at a spinning draft (the ratio of the take-off speed to the spinning linear speed of the fiber spun from the nozzle) of from 0.05 to 1.0 and the resulting unstretched fiber is stretched at a rate of at least 20. According to the disclosed process, in order to make the spinning draft 1 or less by increasing the spinning linear speed, the spinning nozzle used must have an extremely small diameter such as 0.08 mm. Such a nozzle is not only difficult to produce but is capable of providing only fine fibers whose single yarn size is 10 denier or less. Actually, as described in JP-A-61-215711, it is considered essential for the single yarn to have a fineness not exceeding 5 denier in order to obtain high strength and high initial modulus PVA fibers. Thus, high strength and high initial modulus PVA fibers having a single yarn fineness of 5 denier or more which are made from PVA whose polymerization degree is within a commercially available range are currently unknown.

The inventors of the present invention disclosed in Japanese Patent Application No. 1-122030 PVA fibers having a tensile strength of 13 g/d or more, an initial modulus of 300 g/d or more, and a single yarn fineness of 10 denier or more and less than 100 denier and a process for producing the same. The fibers obtained by this process also unavoidably undergo a reduction in strength and initial modulus with an increase in single yarn fineness. If the single yarn fineness exceeded 100 denier, the fiber strength was about 9 g/d at the highest.

On the other hand, a process for producing a thick monofilament yarn by closely adhering a plurality of filaments spun from a plurality of spinning orifices and uniting them into one body is disclosed in U.S. Pat. No. 2,891,277 and British Patent 838,141. The disclosed process is directed to an improvement of the profile of polystyrene fibers, polyester fibers, etc., but not to an improvement of the mechanical properties of monofilament yarns, such as tensile strength and initial modulus.

Cases are often met in which filaments spun from orifices by general melt spinning are adhered to each other under some spinning conditions, and such a phenomenon is regarded as unfavorable because the resulting fibers would have impaired physical properties. To the contrary, it is an improvement of a fiber profile that has been expected by intentionally inducing this phenomenon.

As mentioned above, none of the so far proposed processes for producing PVA fibers having high strength and high initial modulus has achieved high strength and high initial modulus in monofilament yarns having a fineness of not less than 100 denier. It has been a generally accepted belief that strength and initial modulus are reduced as single yarn fineness is increased.

SUMMARY OF THE INVENTION

An object of this invention is to provide a PVA monofilament yarn which has high tensile strength and high initial modulus while having a fineness of 100 denier or more.

Another object of this invention is to provide a process for producing such a PVA monofilament yarn with high productivity.

The inventors conducted extensive investigations in order to solve the above described problems by using PVA whose polymerization degree is within a commercially available range and, as a result, found that a monofilament obtained by closely adhering and uniting a plurality of filaments immediately after being spun from nozzles in an inert atmosphere for dry-wet spinning and then solidifying the filaments into one body provides a product which does not suffer from a reduction in tensile strength or initial modulus even if single yarn fineness is increased.

That is, the present invention relates to a PVA monofilament yarn comprising PVA having a polymerization degree of from 1500 to 7000, a tensile strength of not less than 10 g/d and an initial modulus of not less than 200 g/d, and which has a fineness of 100 denier or more.

The present invention also relates to a process for producing a PVA monofilament yarn which comprises dry-wet spinning a spinning dope prepared by dissolving PVA having a polymerization degree of from 1500 to 7000 in a solvent and stretching the resulting unstretched yarn, wherein a plurality of filaments immediately after being spun from the spinning nozzle having a plurality of orifices are closely adhered and united into a substantially single strand in an inert atmosphere and then introduced into a coagulating bath or a cooling bath.

DETAILED DESCRIPTION OF THE INVENTION

Figure 1:
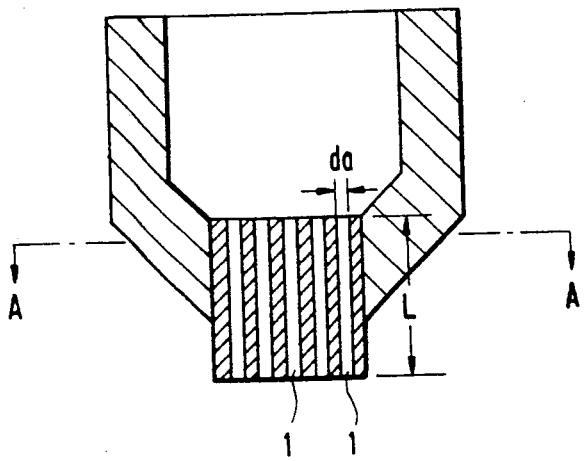
FIG. 1 is a cross-section of one embodiment of a spinning nozzle having a plurality of orifices which can be used in the present invention.

The PVA which can be used in the present invention should have a polymerization degree of at least 1,500, preferably 3,000 or more, more preferably 4,500 or more, and most preferably 6,000 or more. From the economical standpoint, a preferred upper limit is 7,000. If the polymerization degree is less than 1,500, the resulting fiber has a strength less than 10 g/d, thus not achieving the desired level. The PVA preferably has a saponification degree of from 99 to 99.9%.

Spinning solvents which can be used for preparing a PVA spinning dope include saturated aliphatic polyhydric alcohols, e.g., glycerin, ethylene glycol, and propylene glycol, DMSO, dimethylformamide, dimethylimidazolidinone, water, etc., and mixtures thereof. Among them, DMSO, water, and a mixture thereof are preferred. The solvent may appropriately contain a heat resistance improving agent for PVA, a pigment, a cross-linking agent, etc.

The PVA concentration in the spinning dope preferably ranges from 2 to 35% by weight. If it is less than 2% by weight, spinnability is reduced. If it exceeds 35% by weight, stretchability of the unstretched strand tends to be reduced.

The terminology "polymer concentration" as used herein means a weight percentage of the polymer based on the sum of the polymer and a solvent. The spinning dope can be prepared by charging prescribed amounts of the polymer and solvent in a dissolving tank equipped with a stirrer and a heating means and heating the mixture to a temperature of about from 80° to 180° C. while stirring. During spinning, the dope is kept at a temperature of about from 80° to 140° C.

Figure 2:
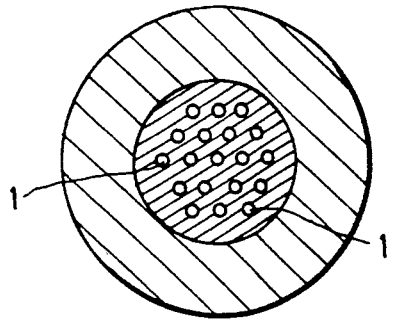
FIG. 2 is a cross-section of the spinning nozzle of FIG. 1 along the line A—A. Numeral 1 in FIG. 2 indicates orifices.

In carrying out dry-wet spinning of the PVA spinning dope to obtain an unstretched yarn (see U.S. Pat. Nos. 4,698,194 and 4,603,083), it is very important for accomplishing the objects of the present invention that a spinning nozzle having a plurality of spinning orifices as shown in FIGS. 1 and 2 be employed and a plurality of filaments immediately after being spun from the orifices are closely adhered and united together in an inert atmosphere into a substantially single strand. The phrase "a plurality of filaments immediately after being spun from the orifices are closely adhered and united together" as used herein means that the filaments spun from orifices are united while the surface thereof is still in a solution state. The terminology "inert atmosphere" as used herein means such an atmosphere in which the surface of filaments spun from orifices may not be coagulated or solidified and may not lose adhesiveness to each other. Thus, the atmosphere does not necessarily need to have a high temperature or be chemically inert like nitrogen. In this sense, even air at room temperature would be inert unless the surface of the filaments spun from orifices loses adhesiveness while passing therethrough.

The stretched monofilament yarn according to the present invention is not a single filament spun from a single spinning orifice as is conventionally obtained, but it is composed of a plurality of filaments spun from a plurality of spinning orifices, which are bound together in an inert atmosphere for dry-wet spinning into a substantially single strand.

The term "a substantially single strand" as used herein means a fiber composed of a plurality of filaments whose surfaces closely adhere to each other in such a manner that the fiber cannot be separated into filaments without damaging each filament. The profile of the substantially single strand does not need to be a circle and may be, for example, a petal shape or a gear shape.

The relationship between the fineness (denier: D]of the stretched monofilament yarn and the number of orifices (n) or the diameter of the orifices (da) of the spinning nozzle is not particularly limited in the present invention. The number of orifices (n) can be adjusted basically depending on the desired fineness of the monofilament yarn. The orifice diameter (da) is preferably between 0.05 mm and 3.0 mm. D and n are preferably determined so that the D/n ratio may exceed 1 but may not exceed 50, and they preferably fall within a range of from 5 to 20.

The length (L) and diameter (da) of an orifice are not independently limited, but the ratio thereof (L/da) is preferably set so as to exceed 5, the industrial upper limit of which is about 20,000. If the L/da ratio is less than 5, the entangled molecular chains cannot be sufficiently untangled, making it difficult to attain a tensile strength of 10 g/d or more.

It will be easy for those skilled in the art to prepare such a spinning nozzle having a plurality of orifices from metals, e.g., iron and stainless steel, or synthetic resins. Spinning nozzles made of metals or synthetic resins with a plurality of stainless steel hollow thin tubes or porous ceramic tubes inserted therein can also be employed.

Since it is important, as described above, for a plurality of filaments to be closely adhered together in an inert atmosphere immediately after being spun from the orifices, tight adhesion of the filaments may be improved, if desired, by extending the inert atmosphere zone or maintaining the temperature of the inert atmosphere at the same temperature as the spinning dope.

In order to adhere a plurality of filaments immediately after being spun, the ratio of center distance (d) between neighboring orifices to length (D) of the inert atmosphere zone (i.e., the distance from the orifice end to the liquid level) is preferably from 4 to 60.

In order to ensure close adhesion of a plurality of filaments immediately after being spun from the orifices, the center distance between neighboring orifices is preferably not more than 5 mm, and more preferably not more than 1 mm. The lower limit of the center distance between neighboring orifices is not particularly limited and may be decided depending on the technique for nozzle production. Accordingly, in the case of a nozzle comprised of a porous ceramic tube, for example, the possible finest nozzle has 200 orifices having a diameter (da) of 0.001 mm, a center distance of 0.005 mm, and a length (L) of 20 mm. In cases where the center distance between neighboring orifices is more than 1 mm and the plurality of filaments hardly adhere to each other immediately after being spun, adhesion can be improved by appropriately adjusting the shape or position of a filament guide fixed in the coagulating bath or cooling bath. More specifically, filaments extruded downwards (vertically) from the spinning nozzle are introduced in a coagulating bath or cooling bath, where they are turned 90° to move in the horizontal direction to the next process step by the guide. Hence, close adhesion of filaments can be assured by fixing a guide capable of gathering filaments, such as a U-shaped guide, at a position within 10 cm of the liquid surface of the bath.

The strand of filaments united into one body in the inert atmosphere is immediately introduced into a coagulating bath or a cooling bath, and the thus solidified strand passes through an extraction step using an extracting solvent to obtain an unstretched yarn.

The terminology "coagulating bath" as used herein means a bath comprising a liquid having capability of coagulating PVA, by which the strand can be solidified. The terminology "cooling bath" as used herein means a bath comprising a liquid at low temperature capable of reducing solubility of PVA in a dissolved stage to cause solidification by precipitation while passing therethrough and incapable of coagulating PVA.

In the coagulating bath or cooling bath, the strand composed of filaments adhered and united in an inert atmosphere zone is merely coagulated or solidified by cooling, respectively. There are, therefore, no particularly limitations on the conditions as long as the coagulating bath has a sufficient coagulating ability, and the cooling bath has a temperature below room temperature. The bath is not limited in size as far as the coagulating or cooling ability may not be lost during spinning. To maintain coagulating or cooling ability, a part of the solution may be continuously withdrawn while supplying the equal amount of a replenisher, by which the bath can be reduced in size.

Examples of suitable coagulating baths and extracting solvents include alcohols, e.g., methanol and ethanol, and ketones, e.g., acetone, with methanol being particularly preferred.

The cooling bath which can be used comprises one or more solvents such as decalin and paraffin oil which exert no coagulating effect on PVA and are not compatible with solvents for PVA. The strand thus solidified through the cooling bath may be then subjected to an extraction step using the above-described extracting solvent.

The extraction step is to extract the solvent for PVA, e.g., dimethyl sulfoxide, with other solvents, preferably those volatile and incapable of dissolving PVA, e.g., methanol. Extraction is preferably carried out until the content of the solvent for PVA in a strand becomes 0.1% by weight or less based on PVA, for example, by treating the strand with methanol containing no dimethyl sulfoxide in a counter-current flow.

In the present invention, untwisting of the tangled molecular chain by the velocity gradient in plurality of orifices is taken advantage of. To this effect, the output rate of spinning is preferably adjusted so that the linear speed ($V_o$) of the spinning dope in the orifice be within a range of from 1 to 10 m/min. Also, the diameter (da) of the orifice is preferably selected so that the Reynolds number (Re) as defined below be within a range of from 0.001 to 2.

$$Re = \frac{da \cdot V_0 \cdot \rho}{\mu}$$

wherein $V_o$ is a linear speed (cm/sec) in an orifice; $\rho$ is a density (g/cm$^3$) of a spinning dope; $\mu$ is a viscosity (g/cm.sec) of a spinning dope; and da is a diameter (cm) of an orifice.

Further, the take-off speed (spinning speed, $V_1$) of unstretched yarn after extraction-drying is preferably selected from a range of from 5 to 40 m/min. It is more preferable that the ratio of take-off speed to linear speed in the orifice ($V_1/V_0$) be from 0.3 to 10.

The thus obtained unstretched yarn is then forwarded to a stretching step either after once being wound or subsequent to the spinning.

If desired, an auxiliary step, such as a drying step and a treatment with oils, may be inserted between the dry-wet spinning step and the stretching step.

Stretching can be carried out by various methods, including, for example, a method in which an unstretched yarn is stretched while in contact with a heating element, e.g., a hot plate; a method of stretching in a hot medium; and a method of stretching in a dielectric heating system. In these methods, stretching can be performed in a single stage or two or more stages (multi-stage stretching). Multi-stage stretching in two or more stages is preferred. In the case of multi-stage stretching, water or oils may be supplied or crosslinking may be conducted between an m'th stage and an (m + 1)'th stage (wherein m means an integer of 1 or more). In the case of multi-stage stretching, it is preferable to make the stretch ratio smaller according as the stage advances.

To obtain the high strength and high initial modulus PVA monofilament yarn having a fineness of 100 denier or more according to the present invention, the overall stretch ratio is preferably from 10 to 25, and more preferably from 15 to 25.

According to the present invention, a high strength and high initial modulus PVA monofilament yarn having a fineness of 100 denier or more can be produced from PVA whose polymerization degree falls within a commercially available range with good productivity and at low cost.

While the tensile strength and initial modulus of the PVA monofilament yarn of the present invention being not particularly limited, these characteristics are increased according as the polymerization degree of PVA increases. However, the higher the polymerization degree, the higher the cost of the polymer. Taking this into consideration, a commercially acceptable upper limit of polymerization degree of PVA is 7000. Accordingly, it is considered, for the sake of guidance, that the monofilament yarn obtained by using PVA having such a commercially acceptable polymerization degree has a strength of about 14.1 g/d and an initial modulus of about 322 g/d at the highest.

On the other hand, a higher fineness can be obtained with ease by using a polymer having a lower polymerization degree. Considering that too a low polymerization degree results in a strength of less than 10 g/d, the possible maximum of a fineness appears to be about 400 denier, which is obtained by using a polymer having a polymerization degree of 1700.

The PVA monofilament yarn according to the present invention is a fiber having a tensile strength of not less than 10 g/d and an initial modulus of not less than 200 g/d at a fineness of 100 denier or more. Hence, it is useful in a broader range of application such as in fishing nets or ropes, a typical application of PVA fibers, and is also promising as a reinforcement for cement, synthetic resins, etc., or as a substitute for asbestos. Namely, it is suited for a wide variety of application as industrial materials..

The tensile strength is preferably 11 g/d or more, more preferably 12 g/d or more, and most preferably 13 g/d orm ore, and the initial modulus is preferably 250 g/d or more, more preferably 270 g/d or more, and most preferably 300 g/d or more.

While the reason for the high tensile strength of not less than 10 g/d and the high initial modulus of not less than 200 g/d for such a high fineness of 100 denier or more is not yet clear, the following assumption seems reasonable.

When PVA spinning dope is extruded through the spinning orifice, the PVA molecular chains undergo a shearing force arising from the velocity gradient in the orifice, whereby the entanglement of molecular chains is untwisted. Where a monofilament yarn comprising a single filament is spun from a single orifice as in conventional techniques, as the desired fineness of the monofilament increases, the diameter of the orifice should be increased and the spinning linear speed is, as a consequence, reduced. As a result, the shearing force imposed on the molecular chains and the effect of untwisting the intertwined molecular chains are reduced in geometric progression, resulting in the production of an unstretched filament structure which still contains many tangled molecular chains.

To the contrary, where a plurality of filaments spun from a plurality of spinning orifices are closely adhered together into a monofilament in an inert atmosphere as in the present invention, the filament size can be increased while maintaining the shearing force exerted on the PVA molecular chains and the untwisting effect at high levels. The thus obtained unstretched strand has a decreased level of entanglement of the molecular chains and has high stretchability and, when stretched, provides a high strength and high initial modulus monofilament yarn.

The terms "tensile strength" and "initial modulus" as used herein are those measured at a clip distance of 25 cm and at a rate of pulling of 30 cm/min in accordance with JIS L-1013.

The present invention is now illustrated in greater detail by way of Examples, but it should be understood that the present invention is not deemed to be limited thereto.

EXAMPLES 1 TO 4 AND COMPARATIVE EXAMPLES 1 AND 2

A DMSO solution of PVA having a polymerization degree of 1700, 3300, 5100 or 7000 was prepared as shown in the Table below by dissolving at 120° C. The solution temperature was maintained at 115° C throughout the spinning. The solution was dry-wet spun into a coagulation bath consisting of methanol of 95% and DMSO of 5% by weight using a spinning nozzle having 30 orifices of 0.5 mm in diameter at 0.8 mm intervals with 20 mm in length, and the resulting 30 filaments were tightly adhered to each other in air to form a single strand, which was then introduced into a methanol bath to extract DMSO therefrom and then dried and wound at a rate of 10 m/min to obtain an unstretched yarn. In these spinning the through-put of the spinning dope was set so that the line velocity in the orifice is 3.8 m/min. The air temperature was 25° C, and the distance between the orifice end and the liquid surface of the bath was kept 5 cm. To ensure close adhesion of filaments, U-shaped guide was fixed 5 cm below the liquid surface of the bath.

The resulting unstretched yarn was stretched through two stages, at 180° C. in the first stage and then at 250° C. in the second stage, to obtain a monofilament yarn.

For comparison, a monofilament yarn was prepared in the same manner as described above, except for using PVA having a polymerization degree of 1300 (Comparative Example 1); or in the same manner as in Example 3, except for using a spinning nozzle having a single orifice having the same sectional area as the total sectional area of the orifices of the spinning nozzle used in Examples 1 to 4 (5.89 $mm^2$)(Comparative Example 2).

The production conditions and properties of the resulting PVA monofilament yarns are shown in the Table.

EXAMPLES 5 TO 7

PVA monofilament yarns were produced in the same manner as in Example 3, except for using a spinning nozzle having 30, 50, or 80 orifices of 0.4 mm in diameter at 0.8 mm intervals.

The properties of the resulting monofilament yarns are shown in the Table.

TABLE

| | Comp. Ex. 1 | Ex. 1 | Ex. 2 | Ex. 3 | Ex. 4 | Comp. Ex. 2 | Ex. 5 | Ex. 6 | Ex. 7 |
|---|---|---|---|---|---|---|---|---|---|
| Spinning Conditions: | | | | | | | | | |
| Polymerization Degree | 1300 | 1700 | 3300 | 5100 | 7000 | 5100 | 5100 | 5100 | 5100 |
| Concentration (wt %) | 29 | 25 | 16 | 12 | 10 | 12 | 12 | 12 | 12 |
| Spinning Orifice: | | | | | | | | | |
| Diameter: da (mm) | 0.5 | 0.5 | 0.5 | 0.5 | 0.5 | 2.7 | 0.4 | 0.4 | 0.4 |
| Length: L (mm) | 4 | 4 | 4 | 4 | 4 | 16.2 | 2.4 | 2.4 | 2.4 |
| L/da | 8 | 8 | 8 | 8 | 8 | 6 | 6 | 6 | 6 |
| Number: n | 30 | 30 | 30 | 30 | 30 | 1 | 30 | 50 | 80 |
| D/n | 13.5 | 11.7 | 7.7 | 5.6 | 4.6 | 165 | 3.7 | 3.9 | 3.8 |
| Stretching Conditions: | | | | | | | | | |
| 1st Stage Stretch Ratio | 10 | 10 | 10 | 10 | 10 | 10 | 10 | 10 | 10 |
| 2nd Stage Stretch Ratio | 1.5 | 1.5 | 1.5 | 1.6 | 1.6 | 1.6 | 1.6 | 1.6 | 1.6 |
| Fiber Properties: | | | | | | | | | |
| Fineness: D (denier) | 405 | 352 | 231 | 167 | 139 | 165 | 112 | 193 | 307 |
| Tensile Strength (g/d) | 8.2 | 10.5 | 11.3 | 12.7 | 14.1 | 7.7 | 12.9 | 12.6 | 12.8 |
| Elongation (%) | 4.7 | 4.1 | 4.6 | 4.3 | 4.9 | 4.1 | 4.9 | 4.8 | 4.6 |
| Initial Modulus (g/d) | 177 | 231 | 255 | 297 | 322 | 149 | 281 | 278 | 288 |

It can be seen from the results in the Table that the PVA monofilament yarn according to the present invention has high strength and high initial modulus for its high fineness of 100 denier or more.

Having a high tensile strength of not less than 10 g/d and a high initial modulus of not less than 200 g/d for a fineness of 100 denier or more, the PVA monofilament yarn of the present invention is quite novel over conventional ones and, therefore, is usable in a broadened range of application as fishing net or rope, typical utilities of PVA fibers. In addition, it is expected to be useful as a reinforcement for cement or synthetic resins or as a substitute for asbestos. The PVA monofilament yarn of the invention is thus suited for various industrial materials.

Further, the process according to the present invention makes it possible to produce a PVA monofilament yarn having the above described advantages with good productivity at low cost.

While the invention has been described in detail and with reference to specific embodiments thereof, it will be apparent to one skilled in the art that various changes and modifications can be made therein without departing from the spirit and scope thereof.

What is claimed is:

1. A polyvinyl alcohol monofilament yarn comprising polyvinyl alcohol having a polymerization degree of from 1500 to 7000, having a tensile strength of not less than 10 g/d and an initial modulus of not less than 200 g/d, and having a fineness of 100 denier to about 400 denier.

2. A polyvinyl alcohol monofilament yarn as claimed in claim 1, wherein the polyvinyl alcohol has a polymerization degree of 3000 to 7000.

3. A polyvinyl alcohol monofilament yarn as claimed in claim 1, wherein the polyvinyl alcohol has a polymerization degree of 4500 to 7000.

4. A polyvinyl alcohol monofilament yarn as claimed in claim 1, wherein the polyvinyl alcohol has a polymerization degree of 6000 to 7000.

5. A polyvinyl alcohol monofilament yarn as claimed in claim 1, wherein said polyvinyl alcohol monofilament yarn has a fineness of 150 denier or more.

6. A polyvinyl alcohol monofilament yarn as claimed in claim 1, wherein said polyvinyl- alcohol monofilament yarn has a fineness of 200 denier to 400.

7. A polyvinyl alcohol monofilament yarn as claimed in claim 1, wherein said polyvinyl alcohol monofilament yarn has a fineness of 300 denier to 400.

8. A polyvinyl alcohol monofilament yarn as claimed in claim 1, wherein said polyvinyl alcohol monofilament yarn has a tensile strength of 11 g/d or more.

9. A polyvinyl alcohol monofilament yarn as claimed in claim 1, wherein said polyvinyl alcohol monofilament yarn has a tensile strength of 12 g/d or more.

10. A polyvinyl alcohol monofilament yarn as claimed in claim 1, wherein said polyvinyl alcohol monofilament yarn has a tensile strength of 13 g/d or more.

11. A polyvinyl alcohol monofilament yarn as claimed in claim 1, wherein said polyvinyl alcohol monofilament yarn has an initial modulus of 250 g/d or more.

12. A polyvinyl alcohol monofilament yarn as claimed in claim 1, wherein said polyvinyl alcohol monofilament yarn has an initial modulus of 270 g/d or more.

13. A polyvinyl alcohol monofilament yarn as claimed in claim 1, wherein said polyvinyl alcohol monofilament yarn has an initial modulus of 300 g/d or more.

* * * * *